US005632597A

United States Patent [19]

Hiroki et al.

[11] Patent Number: 5,632,597

[45] Date of Patent: May 27, 1997

[54] THREAD GROOVE TYPE VACUUM PUMP

[75] Inventors: Seiji Hiroki; Tetsuya Abe; Yoshio Murakami; Junichi Nakamura, all of Naka-machi; Masashi Iguchi, Osaka, all of Japan

[73] Assignee: Osaka Vacuum, Ltd., Osaka, Japan

[21] Appl. No.: 623,014

[22] Filed: Mar. 28, 1996

[30] Foreign Application Priority Data

Mar. 31, 1995 [JP] Japan ..... 7-099666

[51] Int. Cl.[6] ..... F01D 1/36

[52] U.S. Cl. ..... 415/90; 415/73

[58] Field of Search ..... 415/73, 90

[56] References Cited

U.S. PATENT DOCUMENTS 3,697,190 10/1972 Haentjens ..... 415/73
4,746,265 5/1988 Luijten ..... 415/90

FOREIGN PATENT DOCUMENTS 63-154891 6/1988 Japan ..... 415/90
2189295 10/1987 United Kingdom ..... 415/90

*Primary Examiner*—Edward K. Look
*Assistant Examiner*—Christopher Verdier
*Attorney, Agent, or Firm*—Oblon, Spivak, McClelland, Maier & Neustadt, P.C.

[57] ABSTRACT

A thread groove type vacuum pump in which the gap between a rotor and a stator is not subjected to any influence of the rotor temperature and thus the pumping performance does not deteriorate during plasma combustion in a nuclear fusion reactor. The thread groove pumping portion is formed as a circular cone so that the expansion and contraction of the rotor occurs along the generatrix of the circular cone. The pump exhibits supreme pumping performance throughout the whole running mode of the vacuum pumping system of the nuclear fusion reactor because the gap between the rotor and the stator is kept constant despite changes of thermal expansion due to the temperature change of the rotor caused by the different gas loads.

4 Claims, 7 Drawing Sheets

THREAD GROOVE TYPE VACUUM PUMP

BACKGROUND OF THE INVENTION

1. Field of the Invention

The present invention relates to a large thread groove type vacuum pump having a large flow rate and a large pumping speed used for a vacuum pumping system, for example, of a nuclear fusion installation.

2. Description of Background Art

The pumping performance represented by the compression ratio and the pumping speed substantially depends on a gap between a rotor and a stator. It is known that the smaller the gap, the higher the pumping performance. Under a medium vacuum condition such as several tens Pa, a smaller gap is required for lighter gas in order to maintain the desired pumping performance.

Especially in a vacuum pumping system of a nuclear fusion installation, the gap should be made as small as possible since a large amount of light gases such as hydrogen, hydrogen isotope and helium have to be continuously discharged at a maximum level of several tens Pa during the plasma combustion. Since a problem of rotor/stator contact would be caused if the gap is too small, attempts have been made to keep the gap constant along the gas flow passage between the rotor and the stator so that it operates safely.

A method is also known to previously estimate the expansion of the outer diameter of the rotor caused by centrifugal force generated by the rotation of the rotor and then to determine the inner diameter of the stator corresponding to the estimated expansion (e.g. Japanese Laid-open Utility Model Publication No. 91096/1989).

In FIG. 5 which is a longitudinal cross-sectional view showing a thread groove type vacuum pump of the prior art, reference characters "A", "B" and "Cr" denote a rotor, a stator, and a gap between the rotor and the stator, respectively.

The gap between the rotor and the stator should be determined based on the expansion of the outer diameter of the rotor due to its thermal expansion rather than that due to centrifugal force. According to the conventional design, the gap has been determined in accordance with the maximum temperature rise of the rotor in order to avoid the problem of rotor/stator contact.

In the thread groove type vacuum pump used in the vacuum pumping system of a nuclear fusion installation, the inner diameter of the stator is determined to ensure safe operation during the initial air exhaustion since the rotor temperature reaches a maximum during the initial air exhaustion.

On the other hand, since the primary object of the thread groove type vacuum pump used in the nuclear fusion installation is the exhaustion of plasma combustion gases including mainly hydrogen, hydrogen isotope and helium which are lighter than air, the temperature rise of the rotor in this case is less than in the case of exhausting heavier gases such as air. Accordingly, the gap determined in accordance with the conventional design becomes unnecessarily large for use in a nuclear fusion installation. Thus, the design of the prior art extremely lowers the pumping performance of the thread groove type vacuum pump used in the exhaustion of plasma combustion gas and requires an increase in the number of the thread groove type vacuum pumps installed in order to obtain a desired pumping speed.

Since the installation space for the vacuum pumps is limited, a large thread groove type vacuum pump having superior pumping speed per pump is required. However, the change in the gap due to the temperature change must be increased since a large diameter rotor is used in the large pump.

Examples of how the thread groove type vacuum pump of the prior art is affected by different gaps are shown in FIGS. 3 and 4 wherein a performance curve of a large thread groove type vacuum pump having a gap Cr of 0.5 mm used for hydrogen gas is shown in FIG. 3 and that having a gap Cr of 0.78 mm is shown in FIG. 4.

The thread groove type vacuum pump used in these examples has a rotor having a diameter of 600 mm and a length of 800 mm as well as a design specification of a suction pressure Ps of 10 Pa and a flow rate Q of $10^4$ Pa·L/s at a revolution of 142 rps. As can be seen from FIGS. 3 and 4, although it is possible to keep the suction pressure Ps constant within the exhaust pressure of about 200 Pa when the gap Cr is 0.5 mm, the suction pressure Ps is drastically increased when the exhaust pressure exceeds 100 Pa. Accordingly, an auxiliary pump arranged after the thread groove type vacuum pump having the gap Cr of 0.78 mm is required to have a pumping speed twice that of an auxiliary pump arranged after the thread groove type vacuum pump having the gap Cr of 0.5 mm.

Alternatively, when using the same auxiliary pump in both cases, if the exhaust pressure of the thread groove type vacuum pump is set at 200 Pa at a flow rate Q of $10^4$ Pa·L/s, the suction pressure Ps would become 10 Pa when the gap Cr is 0.5 mm and would be increased to 20 Pa when the gap Cr is 0.78 mm.

In addition, as hereinafter described in a second embodiment, when the gap Cr is changed from 0.5 mm to 0.78 mm in order to correspond to the temperature difference 40° C. in the temperature rise of the rotor, it has been found in the conventional thread groove type vacuum pump that the pumping speed is reduced by half.

Thus, in the thread groove type vacuum pumping system used in a nuclear fusion installation, it is necessary to have a structure in which the gap between the rotor and the stator is not influenced by a temperature change of the rotor.

SUMMARY OF THE INVENTION

It is, therefore, an object of the present invention to provide a large thread groove vacuum pump which can keep the gap between the rotor and the stator constant even though the amount of thermal expansion is changed by the temperature rise of the rotor due to the different gas loads.

For achieving the above object, there is provided, according to the present invention, a thread groove type vacuum pump in which the outer peripheral surface of the rotor is formed as a conical surface. The conical surface of the rotor is formed such that an intersection point of an extension of the generatrix of the conical outer peripheral surface of the rotor and the central axis of the rotor shaft is positioned at a distance $(-\beta \cdot Ys)$ from a reference point on the central axis of the shaft, wherein:

$$\beta=(\alpha_s/\alpha_r)\cdot f-1$$

$$f=\Delta Ts/\Delta Tr$$

in which $\alpha_s$ is the coefficient of thermal expansion of a rotor shaft; $\alpha_r$ is the coefficient of thermal expansion of a rotor body; $\Delta Ts$ is the temperature rise of the shaft from the ordinary temperature during the running of the pump; ΔTr is the temperature rise of the rotor from the ordinary temperature during the running of the pump; and Ys is a Y-coordinate of the fitted bottom end of the rotor on the shaft when the position Y of the reference point is zero (0) on the axis of the Y-coordinate set on the central axis of the shaft.

DESCRIPTION OF THE PREFERRED EMBODIMENT

Preferred embodiments of the present invention will be hereinafter described with reference to the accompanying drawings.

Figure 1:
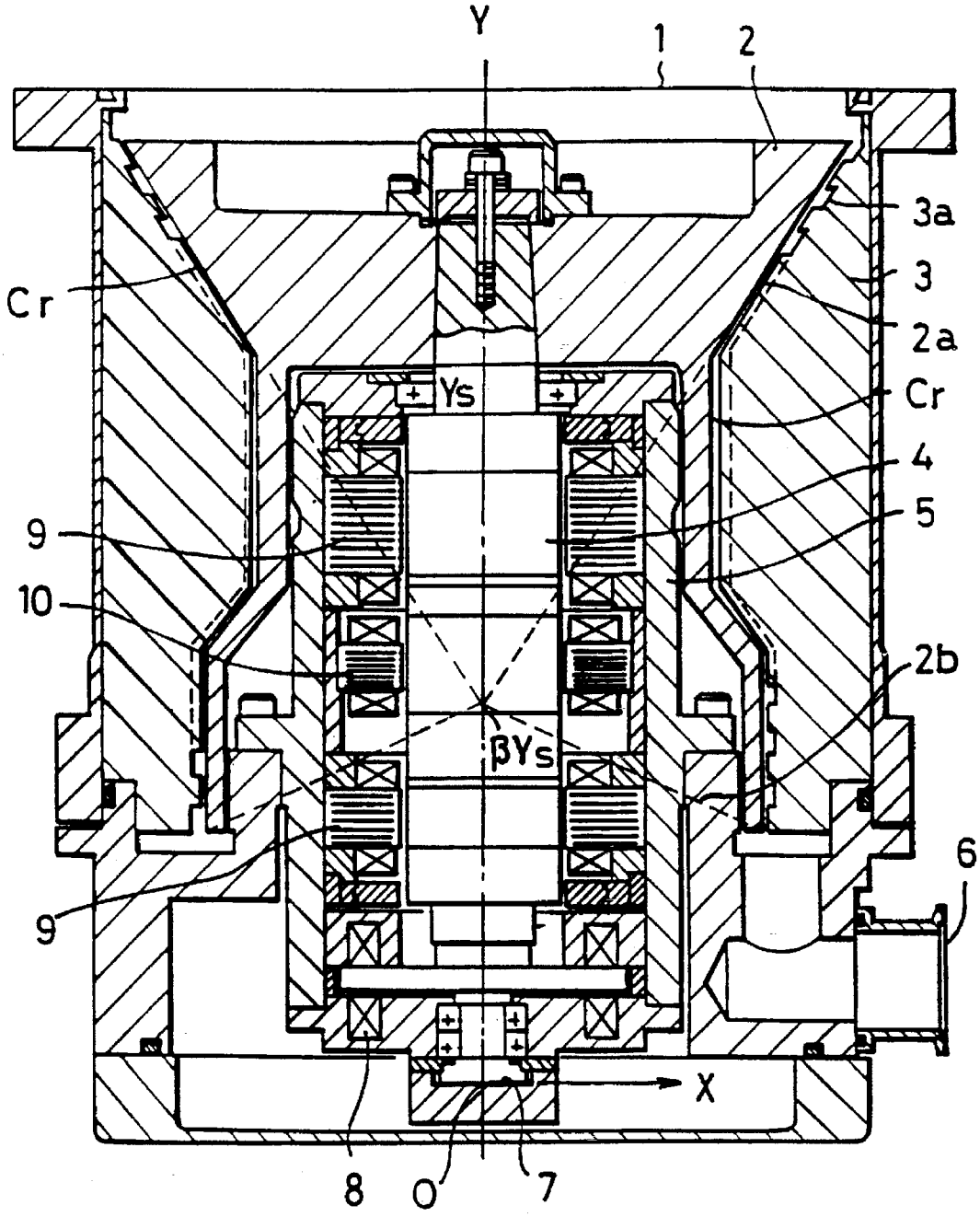
FIG. 1 is a longitudinal cross-sectional view showing a thread groove type vacuum pump of a first embodiment of the present invention.

In FIG. 1 showing a longitudinal cross-sectional view of a thread groove type vacuum pump of a first embodiment of the present invention, reference numeral 1 denotes a suction port, and 2 denotes a rotor, part 2*a* of its outer peripheral surface being conical.

A stator 3 has a thread groove 3*a* on its inner peripheral surface. A minute gap Cr is formed between the rotor 2 and the stator 3.

The rotor 2 is securely fitted on a shaft 4 which bears on a spindle housing 5 via a bearing 9. Reference numeral 10 denotes a motor, 8 denotes a magnetic thrust bearing, and 7 denotes an axial sensor target surface for the magnetic thrust bearing 8 positioned at the bottom end of the shaft 4. Reference numeral 6 denotes a discharge port of the exhaust gas.

Now as shown in FIG. 1, a coordinate system is defined so that the position of the reference point "O" (0, 0) is set on the center of the axial sensor target surface 7. The X-axis extends radially outward through the reference point "O", and the Y-axis extends on the central axis of the shaft toward the suction port 1 through the reference point "O". A coordinate of a certain point on the outer peripheral surface of the rotor 2 is defined as (X, Y).

The Y-coordinate of the bottom end portion of the rotor 2 fitted to the shaft 4 is defined as Ys. When defining the coefficient of thermal expansion of the materials of the rotor 2 and the shaft 4 as $\alpha_r$ and $\alpha_s$ respectively, the temperature rise from the ordinary temperature of the shaft 4 and the rotor 2 as ΔTs and ΔTr respectively, and the temperature rise ratio "f" as ΔTs/ΔTr, the X component ΔX and the Y component ΔY of the displacement of the point on the outer peripheral surface of the rotor 2 is represented as follows;

$$\Delta X=\alpha_r\cdot X\cdot\Delta Tr \tag{i}$$

$$\Delta Y=(\alpha_r\cdot Y+\alpha_s\cdot Ys\cdot f-\alpha_r\cdot Ys)\cdot\Delta Tr \tag{ii}$$

Thus, $$\frac{\Delta Y}{\Delta X}=\frac{(\alpha_s\cdot f-\alpha_r)\cdot Ys+\alpha_r\cdot Y}{\alpha_r\cdot X}=\frac{\left\{\frac{\alpha_s}{\alpha_r}f-1\right\}\cdot Ys+Y}{X} \tag{iii}$$

By replacing as follows, $$\beta=\frac{\alpha_s}{\alpha_r}f-1 \tag{iv}$$

$$\frac{\Delta Y}{\Delta X}=\frac{\beta\cdot Ys+Y}{X} \tag{v}$$

Accordingly, the configuration of the outer peripheral surface corresponds to the solutions of a following differential equation;

$$\frac{dY}{dX}=\frac{\beta\cdot Ys+Y}{X} \tag{vi}$$

The solutions of the equation (vi) are given with using constants $C_1$ and $C_2$ as follows;

When Y>−β·Ys $$Y=C_1\cdot X-\beta\cdot Ys \tag{vii}$$

When Y<−β·Ys $$Y=C_2\cdot X-\beta\cdot Ys \tag{viii}$$

In either case, they will be straight lines in which when Y is −β·Ys, X becomes 0.

In the standard size magnetic bearing type thread groove pump having a suction port diameter of 250 mm shown in the first embodiment of the present invention, the Y-coordinate Ys of the jointed point of the shaft 4 and the rotor 2 is 257 mm; the coefficient $\alpha_r$ of the thermal expansion of the material (aluminum alloy) of the rotor 2 is $23.5\times10^{-6}$; the coefficient $\alpha_s$ of the thermal expansion of the material (high carbon steel) of the shaft 4 is $10\times10^{-6}$; and "f" is standard value of 1.1. Thus, β can be obtained as −0.532 from the previous expression (iv). Accordingly, $$-\beta\cdot Ys=136.7\ mm \tag{ix}$$

Thus, the position of the apex of the circular cone 2*a* hereinafter mentioned is determined at a distance of 136.7 mm from the origin "O".

That is, two circular cones each having the linear generatrix obtained by the expressions (vii) and (viii) are shown in FIG. 1 by reference numerals 2*a* and 2*b* respectively. In these circular cones 2*a* and 2*b*, since portions shown by dotted lines interfere with the spindle housing 5 and others, only portions shown by solid lines of the circular cone 2*a* form the outer peripheral surfaces of the rotor 2.

The operation of the first embodiment of the present invention will be hereinafter described.

The temperature rises ΔTs and ΔTr respectively of the shaft 4 and rotor 2 during the running thereof are greatly affected by the loading conditions (e.g. gas flow rate, types of gas, exhaust pressure, etc.).

However, the ratio "f" (=ΔTs/ΔTr) is substantially constant with respect to changes of the loading conditions.

That is, the increment of the frictional heat on the surface of the rotor 2 is proportional to the increment of the pressure around the rotor 2, although the pressure around the rotor 2 rises due to the increase of the gas load. On the other hand, the increment of the power consumption of the motor 10 is proportional to the increment of the frictional energy on the surface of the rotor 2, and the increment of the energy loss of the motor armature (not shown) is proportional to the increment of the power consumption of the motor 10.

Although heat dissipation is carried out through heat conduction from the surface of the rotor 2 via gas molecules when the gas load exceeds a certain value, the increment of the heat dissipation is proportional to the rise of pressure around the rotor 2, and the heat conduction from the shaft 4 to the rotor 2 is proportional to the temperature difference between the rotor 2 and the shaft 4. Ultimately, the ratio "f" (=ΔTs/ΔTr) will be constant when the gas load exceeds a certain value.

Since the ratio ($\alpha_s/\alpha_r$) of the coefficient of thermal expansion is also substantially constant with respect to the change of the loading conditions, the value of "β" is kept constant during the running of the pump irrespective of changes of the load.

Accordingly, the outer peripheral surface of the rotor 2 is displaced only in its tangential direction (i.e. the direction of the generatrix of the circular cone 2*a*) even though the rotor 2 and the shaft 4 are subjected to thermal expansion.

Thus, the gap Cr between the circular cone 2*a* of the rotor 2 and the inner peripheral surface of the stator 3 does not change at all since the inner peripheral surface of the stator 3 is parallel to the circular cone 2*a* of the rotor 2.

That is, by shaping part of the outer peripheral surface of the rotor 2 as a circular cone 2*a* of the present invention, it is possible to avoid any concern for the extension caused by the thermal expansion of the outer surface of the rotor 2.

It is very difficult to keep the gap Cr constant by controlling the temperature of the rotor 2 and the stator 3 because it is very difficult to control the temperature of the rotor 2, which is thermally insulated within a vacuum by using any thermal control means from the outside.

In the first embodiment, the deterioration of the pumping performance during the plasma combustion can be substantially improved since the gap Cr is kept constant despite the temperature change of the pump.

Figure 6:
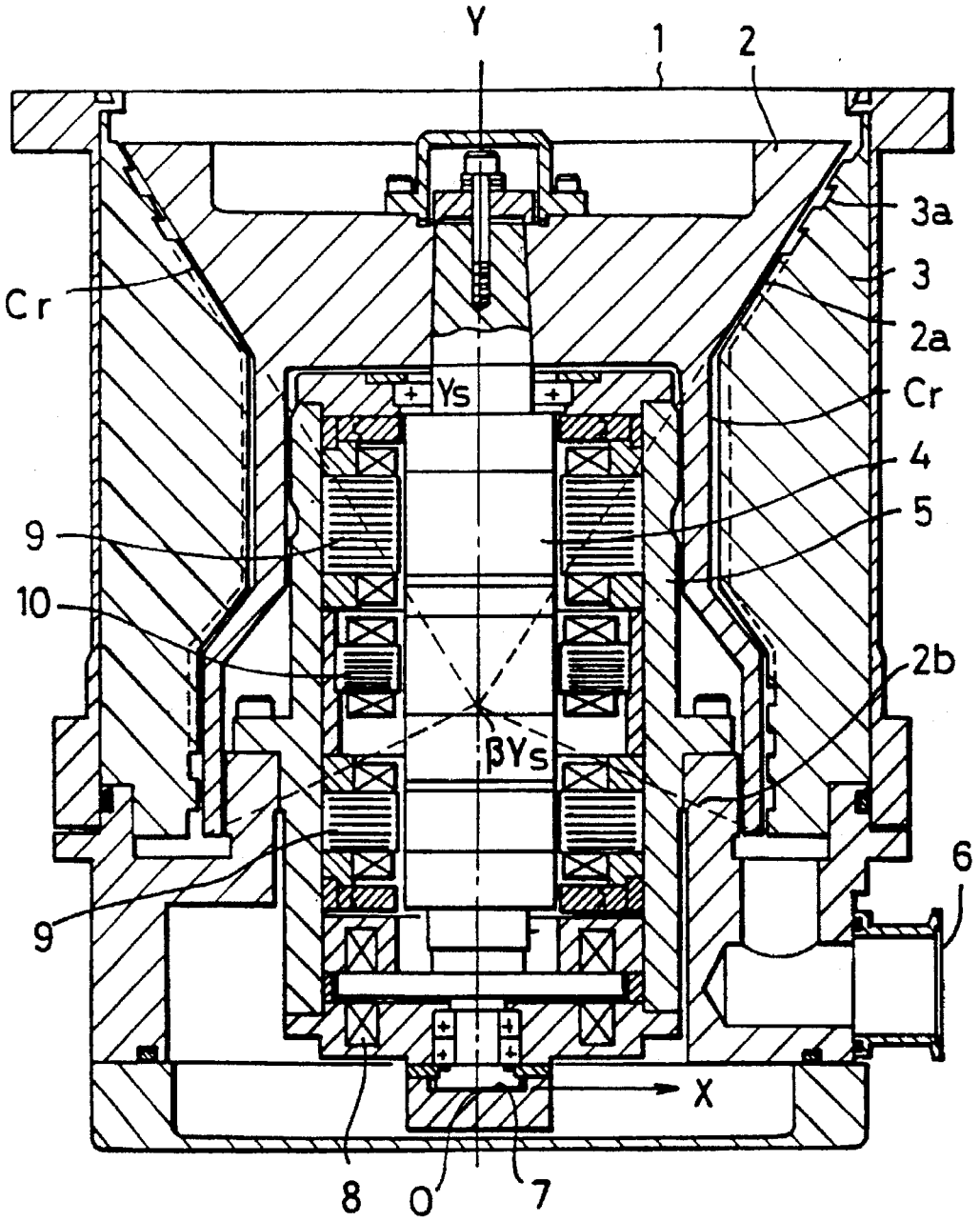
FIG. 6 is longitudinal cross-sectional view showing a thread groove type vacuum pump of a third embodiment of the present invention.

A third embodiment of the present invention is seen in FIG. 6. This embodiment is identical to the first embodiment except that the thread grooves 3*a* are formed on the outer peripheral surface of the rotor 2.

A second embodiment of the present invention will be hereinafter described with reference to FIG. 2 which is a longitudinal cross-sectional view of a thread groove type vacuum pump of the second embodiment of the present invention.

Figure 7:
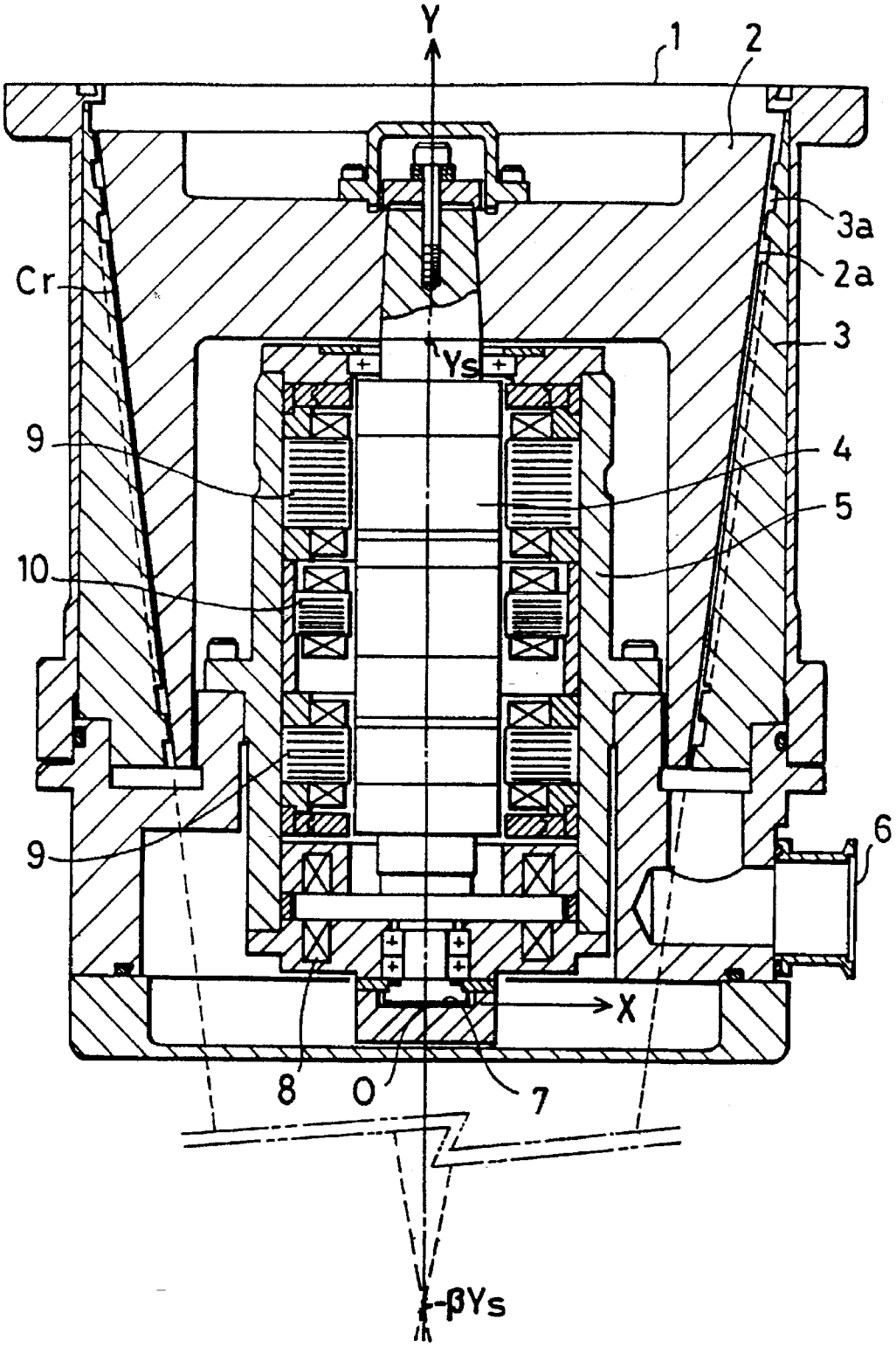
FIG. 7 is a longitudinal cross-section view showing a thread groove type vacuum pump of a fourth embodiment of the present invention.

A fourth embodiment of the present invention is seen in FIG. 7. This embodiment is identical to the second embodiment except that the thread grooves 3*a* are formed on the outer peripheral surface of the rotor 2.

In this embodiment, the shaft 4 is formed from manganese steel for machine structural use having high strength and high coefficient of thermal expansion ($\alpha_s$=14.6×10$^{-6}$) and the rotor 2 is formed from 6–4 titanium alloy having high specific strength and low coefficient of thermal expansion ($\alpha_r$=8.4×10$^{31\ 6}$).

Further in this embodiment, conventional means for reducing energy loss of the motor 10 intended to suppress the temperature rise of the shaft 2 is not used. On the contrary, this embodiment intends to have the ratio ("f"=2) of temperature rise by increasing the energy loss of the bearing 9 for increasing the temperature rise of the shaft 4 or by positively increasing the amount of heat generation of the armature (not shown) proportional to the load of the motor 10.

In this case, "β" becomes 2.48 from the expression (iv) and the position of the apex of the circular cone 2*a* becomes a negative value as follows;

$$-\beta \cdot Ys = -637\ mm \qquad \text{(x)}$$

Figure 2:
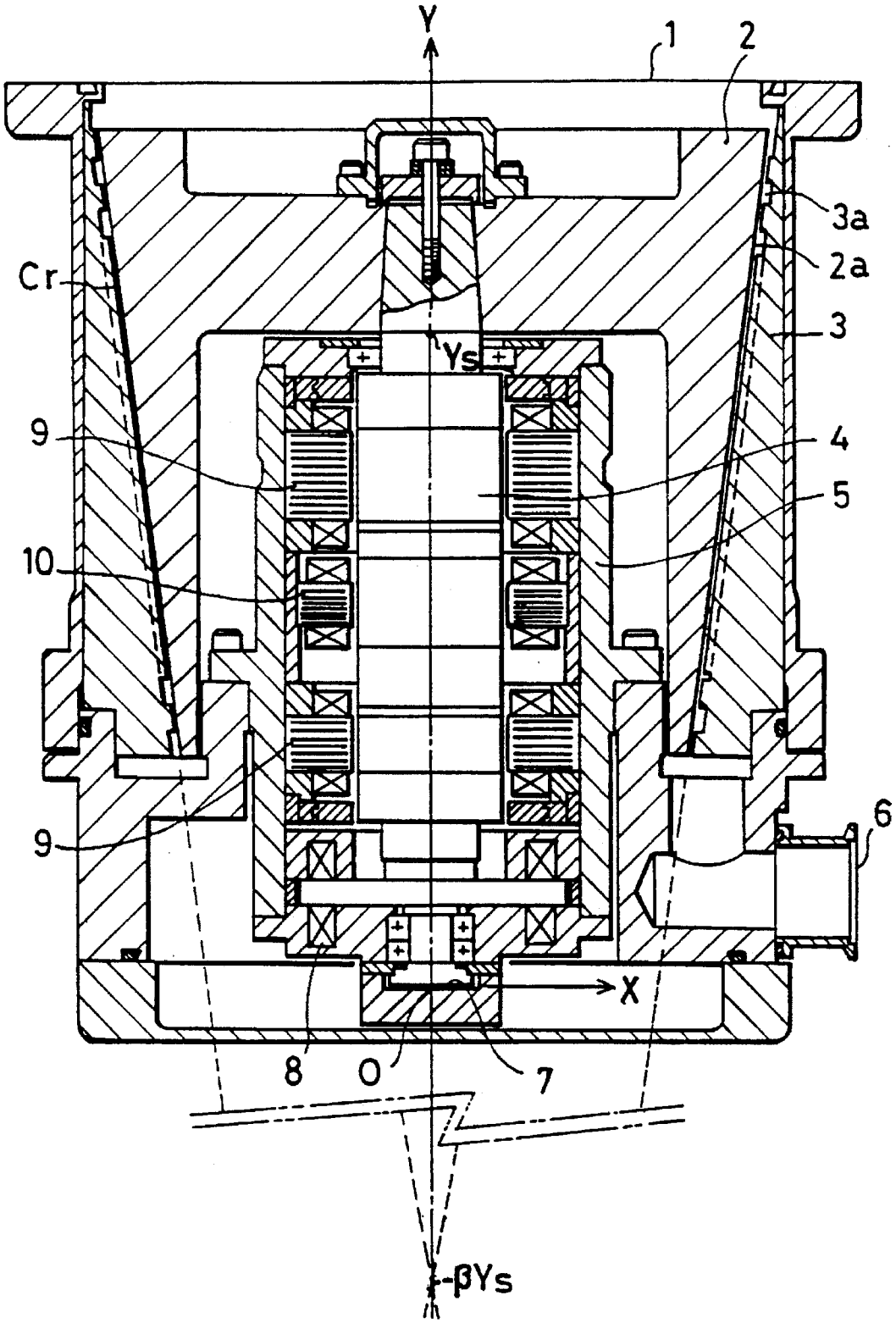
FIG. 2 is a longitudinal cross-sectional view showing a thread groove type vacuum pump of a second embodiment of the present invention.

In this case, the circular cone 2*a* of the present invention is formed on the whole outer peripheral surface of the rotor 2 as shown in FIG. 2.

The operation of the second embodiment of the present invention will be hereinafter described.

In the thread groove type vacuum pump used in the pumping system of the nuclear fusion installation, the temperature rise of the rotor 2 reaches a maximum during the initial exhaust ion and ΔTr will become about 100° C.

On the other hand, since light gases are exhausted during exhaustion of the plasma combustion gas which is a main function of the thread groove type vacuum pump, ΔTr will become about 60° C. which is lower by about 40° C. than that during the initial exhaustion.

In a large thread groove type vacuum pump comprising a rotor 2 having a diameter of about 600 mm, the minimum possible gap Cr necessary to prevent contact between the rotor 2 and the stator 3 will be about 0.5 mm due to the fitting tolerance and the radial displacement of the rotor 2 allowed by the magnetic bearing 9.

When the Cr becomes 0.5 mm at the temperature rise ΔTr (=100° C.) of the rotor 2, the gap Cr' of the conventional thread groove type vacuum pump made of aluminum alloy will become 0.78 mm as follows;

$$Cr' = 0.5 + 300 \times 23.5 \times 10^{-6} \times 40 = 0.78\ mm \qquad \text{(xi)}$$

On the contrary, according to the second embodiment of the present invention, the gap Cr is kept constant (0.5 mm) since the expansion and contraction of the rotor 2 occurs along the circular cone 2*a* by the change of the temperature rise ΔTr.

Figure 3:
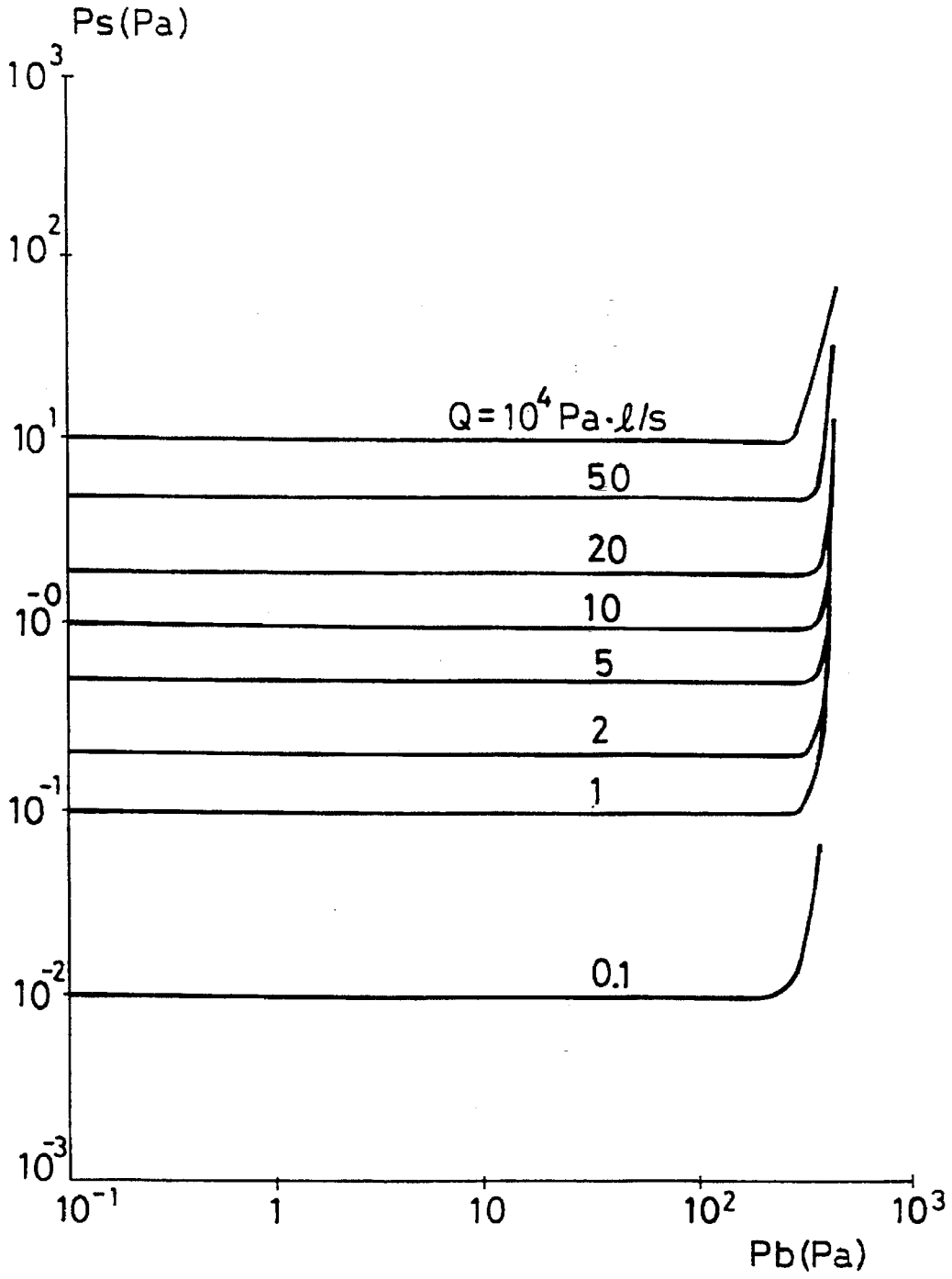
FIG. 3 is a graph showing the pumping performance of a thread groove type vacuum pump having a gap Cr of 0.5 mm.
Figure 4:
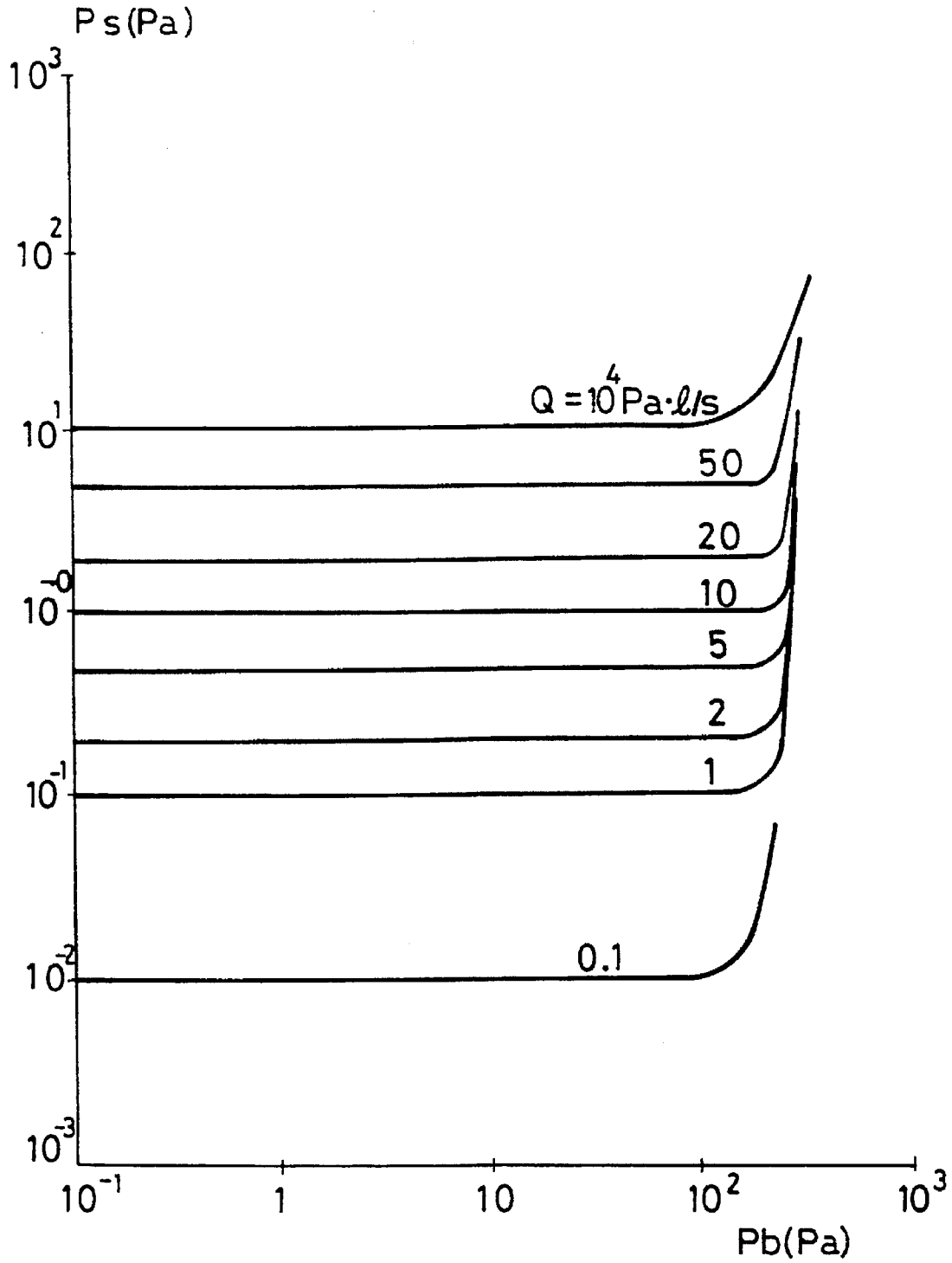
FIG. 4 is a graph showing the pumping performance of a thread groove type vacuum pump having a gap Cr of 0.78 mm.
Figure 5:
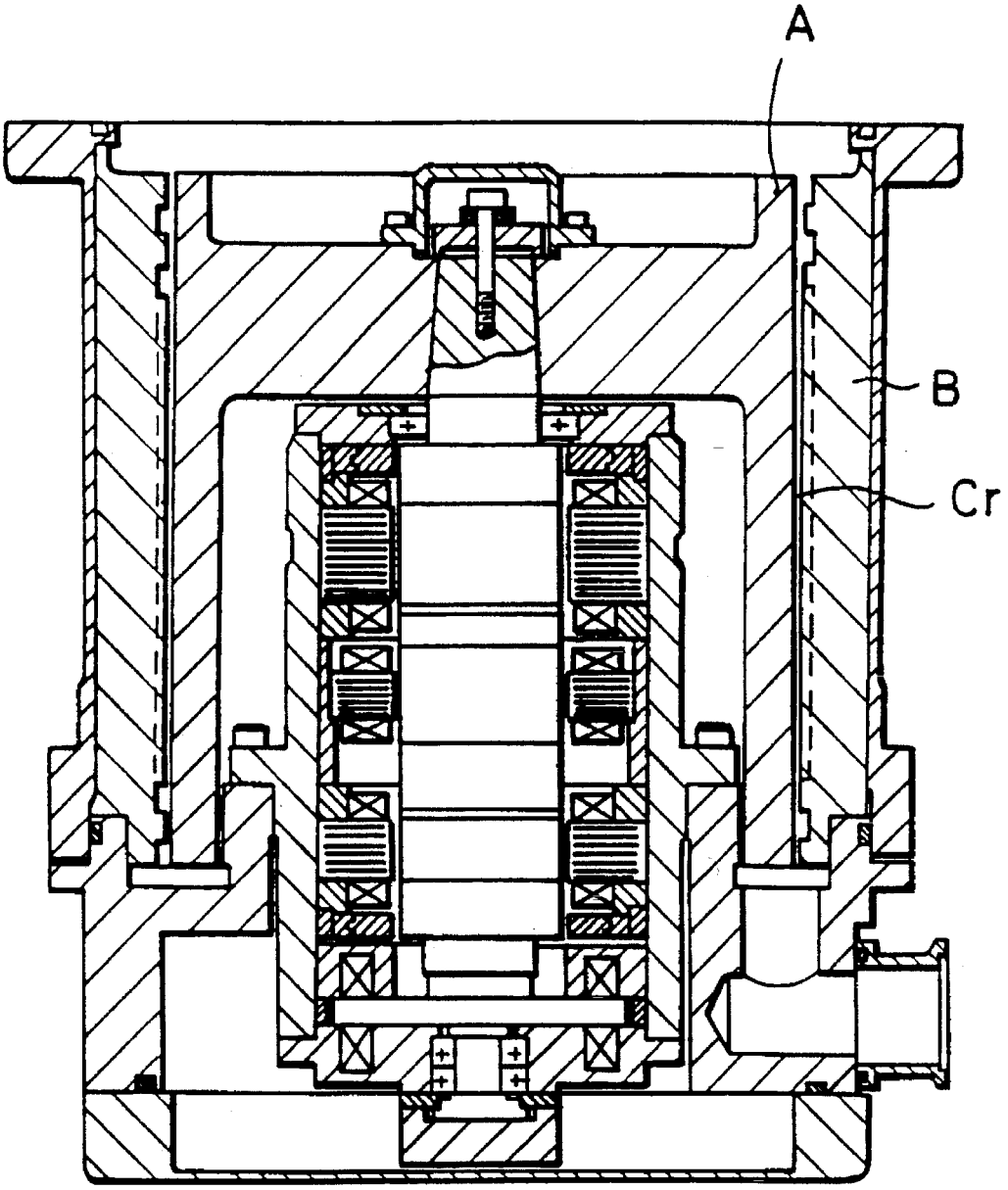
FIG. 5 PRIOR ART
FIG. 5 is a longitudinal cross-sectional view showing a thread groove type vacuum pump of the prior art.

The pumping performance is affected by the change in the gap between 0.5 mm and 0.78 mm as is apparent from previous explanations described as to FIGS. 3 and 4.

That is, in the second embodiment, since the whole thread groove pumping portion is formed as the circular cone 2*a*, it is possible to keep the gap Cr constant (e.g. 0.5 mm) throughout the circular cone 2*a* despite any change in temperature and thus to prevent the pumping performance from deteriorating during the exhaustion of the plasma combustion gas.

What is claimed as new and desired to be secured by Letters Patent of the United States is:

1. A thread groove type vacuum pump, in which a thread groove is formed on either the outer peripheral surface of a rotor or on the inner peripheral surface of a stator, the rotor rotating about a central axis of a rotor shaft within the stator with a gap therebetween, at least part of the outer peripheral surface of the rotor being formed by at least one conical surface and the conical surface of the rotor being formed such that an intersection point of an extension of a generatrix of the conical outer peripheral surface of the rotor and a central axis of the rotor shaft is positioned at a distance ($-\beta \cdot Ys$) from a reference point on a thrust bearing arranged on the central axis of the shaft, wherein;

$$\beta=(\alpha_s/\alpha_r)\cdot f-1$$

$$f=\Delta Ts/\Delta Tr$$

in which $\alpha_s$ is a coefficient of thermal expansion of the rotor shaft; $\alpha_r$ is a coefficient of thermal expansion of a rotor body; $\Delta Ts$ is a temperature rise of the shaft from ordinary temperature during the running of the pump; $\Delta Tr$ is a temperature rise of the rotor from ordinary temperature during the running of the pump; and Ys is a Y-coordinate of a fitted bottom end of the rotor on the shaft when the position Y of the reference point is zero (0) on the axis of the Y-coordinate set on the central axis of the shaft.

2. A thread groove type vacuum pump according to claim 1 wherein the bearing is a magnetic bearing, and the reference point is positioned on a target surface of an axial sensor.

3. A thread groove type vacuum pump according to claim 1 wherein the coefficient of thermal expansion $\alpha_s$ of the material of the shaft is larger than the coefficient of thermal expansion $\alpha_r$ of the material of the rotor.

4. A thread groove type vacuum pump according to claim 3 wherein $\Delta Ts/\Delta Tr \times \alpha_s/\alpha_r > 1$.

* * * * *